US005221123A

United States Patent [19]

Klinkhammer

[11] Patent Number: 5,221,123

[45] Date of Patent: Jun. 22, 1993

[54] BRISTLES CLUSTERS, BRUSHES, AND THEIR MANUFACTURE

[76] Inventor: Ronald W. Klinkhammer, 12621 Renton Ave. South, Seattle, Wash. 98178

[21] Appl. No.: 690,494

[22] Filed: Apr. 24, 1991

[51] Int. Cl.[5] ..... A46D 1/08

[52] U.S. Cl. ..... 300/2; 300/4; 300/6; 300/21; 264/243; 264/334; 425/422; 425/444

[58] Field of Search ..... 264/243, 334; 300/2-11, 21; 15/191 R; 425/805, 422, 444, 443

[56] References Cited

U.S. PATENT DOCUMENTS

| | | | |
|---|---|---|---|
| 2,783,490 | 3/1957 | Kutik | 300/21 X |
| 3,597,787 | 8/1971 | Rosendall . | |
| 3,641,611 | 2/1972 | Schofield . | |
| 4,255,224 | 3/1981 | Lorenz . | |
| 4,310,377 | 1/1982 | Lorenz . | |
| 4,373,541 | 2/1983 | Nishioka . | |
| 4,422,986 | 12/1983 | Cole | 425/444 X |
| 4,616,374 | 10/1986 | Novogrodsky . | |
| 4,635,313 | 1/1987 | Fassler et al. . | |
| 4,637,660 | 1/1987 | Wiehrauch | 264/243 X |
| 4,646,381 | 3/1987 | Weihrauch . | |
| 4,687,257 | 8/1987 | Stern . | |
| 4,741,066 | 5/1988 | Ito et al. . | |
| 4,768,837 | 9/1988 | Boucherle . | |
| 4,988,146 | 1/1991 | Weihrauch | 264/243 X |
| 5,011,230 | 4/1991 | Weihrauch | 300/21 |

FOREIGN PATENT DOCUMENTS

| | | | |
|---|---|---|---|
| 1160821 | 1/1964 | Fed. Rep. of Germany | 300/21 |
| 3637750 | 5/1988 | Fed. Rep. of Germany | 300/21 |

*Primary Examiner*—Mark Rosenbaum
*Assistant Examiner*—Kenneth J. Hansen
*Attorney, Agent, or Firm*—Wells, St. John, Roberts, Gregory & Matkin

[57] ABSTRACT

Disclosed are new brush constructions having at least one receptable formed into a brush piece. The receptacles receive integrally formed bristle clusters which each have a plurality of bristles or tines. The receptacles include a central cavity preferably surrounded by deflection flutes. The flutes receive the tines and force them together and into upstanding orientations. The central cavity extends below the flutes to provide a stabilizer receptacle which receives a stabilizer portion of the bristle cluster core. The bristle clusters are comprised of a plurality of tines which are connected at a central juncture and extend outwardly when the bristle cluster is in the relaxed uninstalled condition. The invention further discloses an apparatus and method for making the brushes by simultaneously ejecting the bristle clusters from a mold and into the receptacles in the brush piece. The tines of the bristle clusters are redirected by the flutes or other displacement feature of the receptacles as the bristle clusters are installed in the brush.

30 Claims, 8 Drawing Sheets

Fig 1
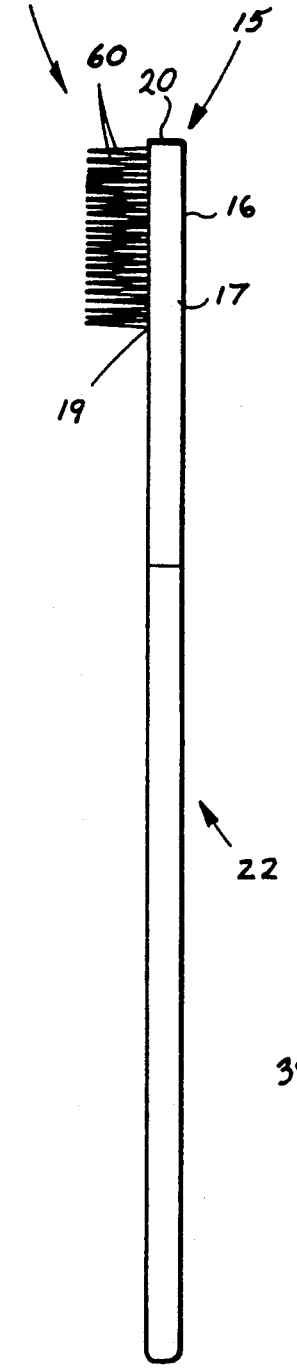
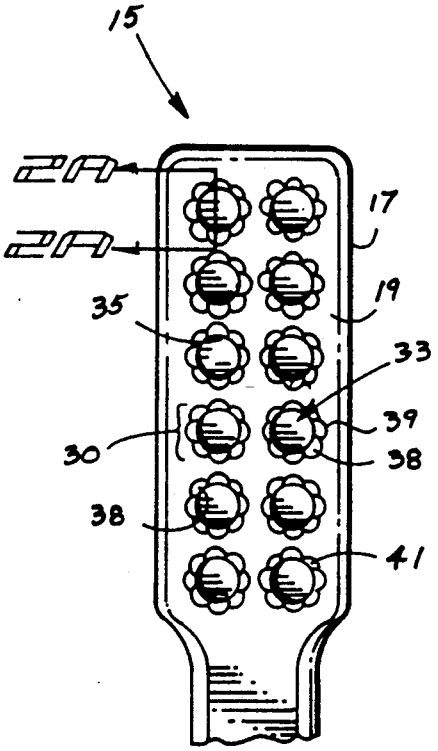
Fig 2
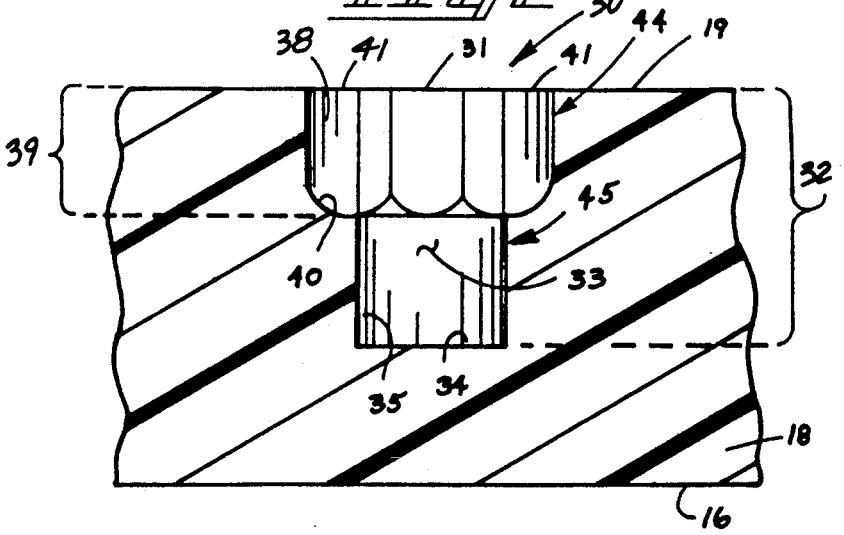
Fig 2A

Fig 15
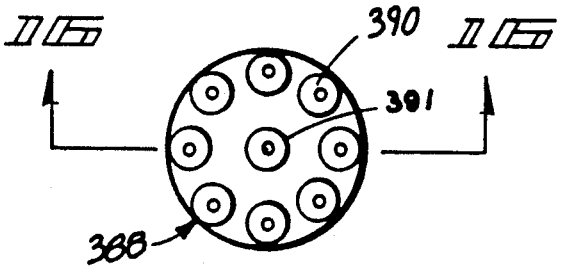
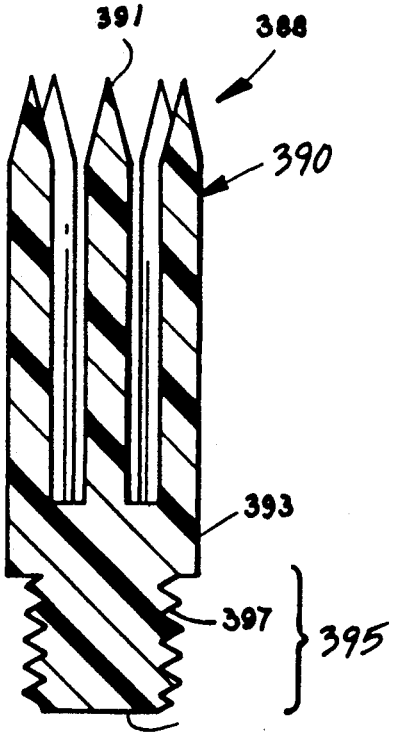
Fig 16
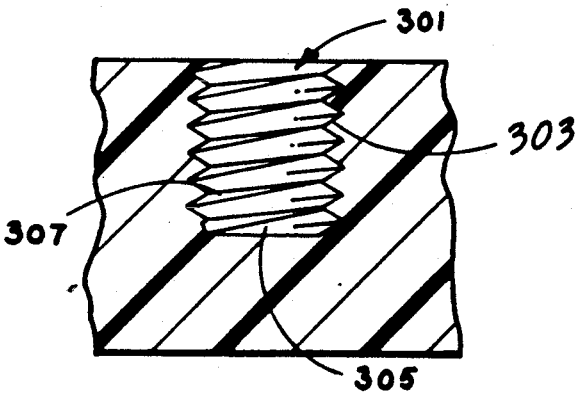
Fig 17

BRISTLES CLUSTERS, BRUSHES, AND THEIR MANUFACTURE

TECHNICAL FIELD

The field of this invention is brush construction.

BACKGROUND OF THE INVENTION

Commonly used methods of manufacturing brushes, such as toothbrushes, hairbrushes, and cleaning brushes, often include the process of binding or joining monofilament bristles into tufts. This approach to brush construction involves a number of manufacturing steps. The monofilament bristles must first be produced and cut to the appropriate length. The resulting bristles must then be collected into the tufts and the tufts bound together. The tufts are then inserted individually into the base or head of the brush and secured therein using friction adhesives or fastening systems. The several processing steps involved in these processes increase the amount of machinery needed to produce brushes with a resulting cost to the consumer.

U.S. Pat. No. 4,635,313 to Fassler et al. shows a process for manufacturing brushes in which the ends of the bristles used to form a tuft are fused into a ball. The head of the brush is then molded around the ball shaped ends of the tufts. The ball shaped ends are shaped and formed so that they hold the tuft into the body of the brush.

Despite the apparent simplicity of brushes to the consumer, there remains a need in the art for improved brushes which are more economical to produce and capable of more flexibility in the characteristics of the resulting brush. The present invention represents a new and unique approach to the manufacture of brushes.

BRIEF DESCRIPTION OF THE DRAWINGS

One or more preferred embodiments of the invention are illustrated in the accompanying drawings, which are briefly described below.

FIG. 1 is a side elevational view of a brush according to this invention.

FIG. 2 is an enlarged partial front elevational view of the brush of FIG. 1 with the bristle clusters removed.

FIG. 2A shows an enlarged sectional view taken along line 2A—2A showing a portion of the brush head detailing a receptacle from FIG. 2.

FIG. 15 is a top plan view of an alternative embodiment of a bristle cluster according to this invention.

FIG. 16 is a sectional view of the bristle cluster of FIG. 15 taken along line 16—16.

FIG. 17 is a sectional view of an alternative embodiment brush head having a receptacle for receiving the bristle cluster of FIG. 15.

DETAILED DESCRIPTION OF THE PREFERRED EMBODIMENTS

Figure 3:
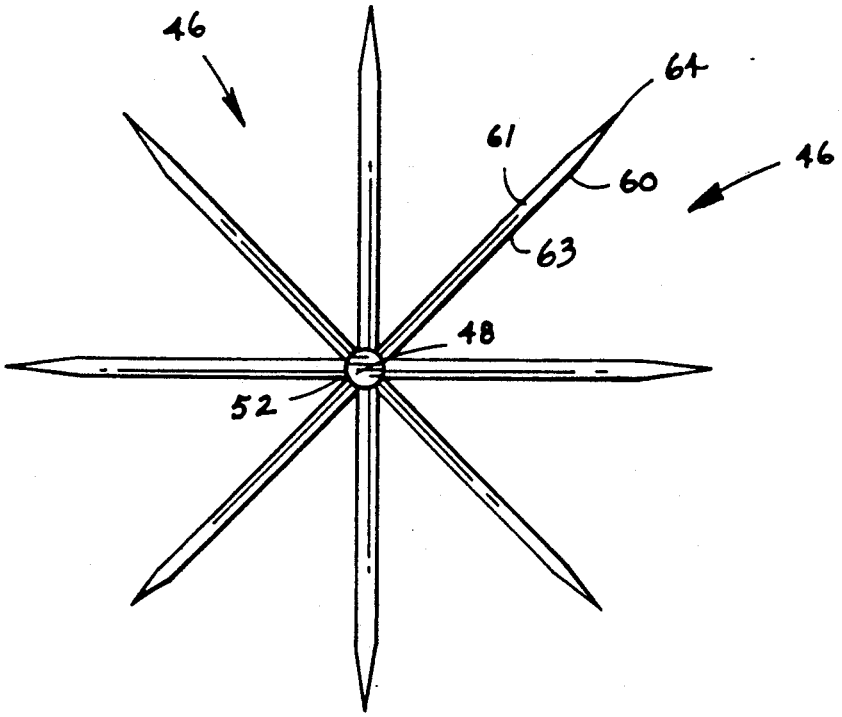
FIG. 3 is a top view of a bristle cluster according to this invention in a relaxed condition.

This disclosure of the invention is submitted in furtherance of the constitutional purposes of the Patent Laws "to promote the progress of science and useful arts" (Article 1, Section 8).

FIG. 1 shows a brush 10 according to this invention having a brush piece 15 and a plurality of bristle clusters 46. Bristle clusters 46 have displaced tines or bristles 60 which extend outwardly to form a brush bristle arrangement or array. The brush piece 15 is a body advantageously formed to include a back surface 16, a side surface 17, a top surface 20, and a front face 19. As shown, brush piece 15 has a handle 22 allowing it to serve as a toothbrush. The brushes, bristles clusters and brush pieces of this invention are not limited to toothbrushes, and may also be used for hairbrushes, cleaning brushes, and other brushes for various domestic and commercial uses. The brush pieces may be made from a variety of suitable materials known in the art. Injected molded plastics made of synthetic resins will typically be used.

Brush piece 15 further includes at least one bristle cluster receptacle on a suitable surface or surfaces of the brush piece. FIG. 2 shows brush piece 15 with a plurality of receptacles 30 on the front surface 19. Receptacles 30 are also shown in greater detail in the sectional view of FIG. 2A. Receptacles 30 have opening 31 at the surface 19 of the brush piece, with remaining portions of the receptacle typically recessed into the body of the brush piece.

Receptacles 30 have bottom surfaces 34 and sidewalls 32. The receptacles include a center or central cavity portion 33 which extends from the opening to the bottom wall 34 and is primarily defined by the shape of the bottom wall. The central cavity may be cylindrical or other suitable shape.

In addition to the central cavity, receptacles 30 include a tine deflection or orientation feature for reorienting or deflecting the tines 60 into desired orientations for a variety of potential brush arrays. As shown, the tine deflection feature is advantageously provided in the form of deflection flutes 38. FIG. 2 shows a series of deflection flutes 38 arranged about the central cavity forming a scalloped or fluted outer perimeter to the opening 31. The deflection flutes define an upper or first zone 44 of the receptacle between the opening and the lower end of the flutes which also has the fluted or scalloped shape when viewed in cross-section. A second or lower zone 45 comprises the portion of the central cavity below the bottom of the flutes 38. The flutes of this embodiment form a continuous pattern around the central cavity. Alternatively, they may be intermittently spaced around the central cavity in an arrangement suitable to deflect the particular number of tines 60 which are being reoriented. The deflection flutes are of a semi-circular cross-sectional shape as may be seen in FIG. 2, but may be of any appropriate shape suitable for the size and shape of the tines which are reoriented thereby.

FIG. 2A shows the preferred longitudinal shape of the sidewalls along the trough of flutes 38. The flutes are open at a flute open are 41 which conjoins to form a portion of the receptacle opening 31. The sidewall of each flute extends downwardly and begins converging at a suitable point to form a concave corner or fillet shaped transition zone 40 which is advantageously curved to meet with the central cavity sidewall 35. The extent of the transition zone will vary dependent upon the size of tines 60 and the geometry of the flutes and receptacle. As shown, the upper zone including the flutes and transition is approximately half of the depth of receptacle 30. The converging transition zone may form a part or all of the sidewall within the fluted parts of the upper zone.

Figure 4:
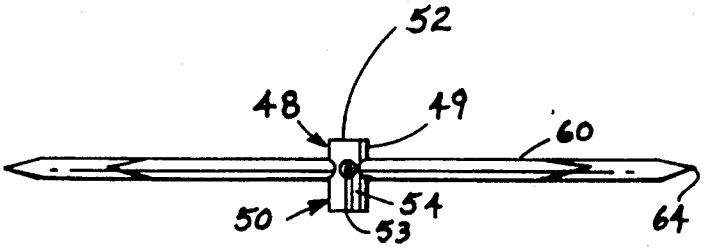
FIG. 4 is a side elevational view of the bristle cluster of FIG. 3.
Figure 6:
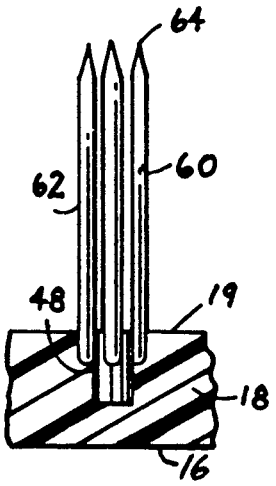
FIG. 6 is a sectional view similar to FIG. 5 with a bristle cluster inserted into the receptacle.

Brush 10 further includes bristle clusters 46 one of which is shown in isolation in FIGS. 3 and 4. Bristle clusters 46 are mounted in the bristle cluster receptacles 30. FIGS. 1 and 6 show that the tines or bristles 60 protrude from the front surface 19 of brush piece 15, when the bristle clusters have been inserted into and mounted within the bristle cluster receptacles 30.

Bristle clusters 46 are each advantageously formed as an integral unit having a plurality of transverse tines 60. The tines are integrally joined at a central juncture which is advantageously provided in the form of central core 48. Central core 48 can be formed in a variety of suitable shapes including the cylindrical shape shown, and others such as prismatic. As shown, central core 48 includes an upper portion 49 and a lower portion 50. The upper and lower portions are joined along a line or plane which approximates or defines the positions of the outwardly extending tines 60. The core 48 also has a top face 52, a bottom face 53, and an outer sidewall surface 54. In this embodiment, the bottom face 53 is the same approximate shape and size as top face 52. Tines 60 are oriented upon a perpendicular transverse plane with respect to the longitudinal axis of core 48. Tines 60 can also be arranged in other suitable transverse relationships to the core or other form of juncture.

FIG. 3 shows the top view of bristle cluster 46. This bristle cluster is comprised of eight tines radiating outwardly from the central core along angularly spaced radial orientations which are at approximately equal angular distances of 45° of arc. The tines 60 and the central core 48 are formed as an integral, preferably molded unit. Each tine 60 includes an upper surface 61, and lower surface 62, and an end point 64. The distal ends of tines 60 are advantageously tapered. The tines 60 of the bristle cluster 46 are of substantially the same length. Varying number of tines may be used in bristle clusters made in accordance with this invention.

Figure 5:
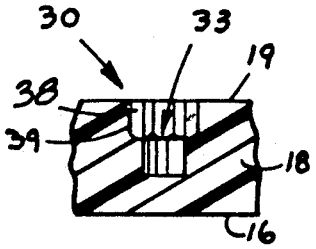
FIG. 5 is a sectional view of a bristle cluster receptacle of FIG. 2 without a bristle cluster.

FIG. 5 shows the bristle cluster receptacle 30 of FIGS. 2 and 2A. This receptacle is formed to receive the bristle clusters 46 of FIG. 3. FIG. 6 shows bristle cluster 46 after it has been inserted into receptacle 30 and is mounted therein. The core 48 of the bristle cluster fits into and substantially fills the central cavity 33 of the receptacle. The bottom face 53 of the core rests against the bottom surface 34 of the receptacle. The lower portion 50 of the core forms a bristle cluster mounting part or stabilizer which extends into the lower zone 45 of receptacle 30. The lower stabilizer 50 preferably is sized and shaped to snugly or tightly fit into the stabilizer receptacle formed by lower zone 45. The mating engagement of stabilizer 50 with the stabilizer receptacle portion 45 resists displacement of the bristle cluster when subjected to transverse forces applied to the upstanding times of FIG. 6 when the brush is used in the typical fashion.

The deflection or reorientation flutes 38 of the receptacle displace the tines from their outwardly extending transverse orientations in the relaxed position of FIG. 3, and hold them in the realigned installed positions of FIG. 6. The realigned installed positions of tines 60 are typically together and in an axial orientation relative to the axis of the receptacle 30 and axis of core 48. As shown, this is approximately 90 degrees from the perpendicularly transverse relaxed positions.

Figure 7:
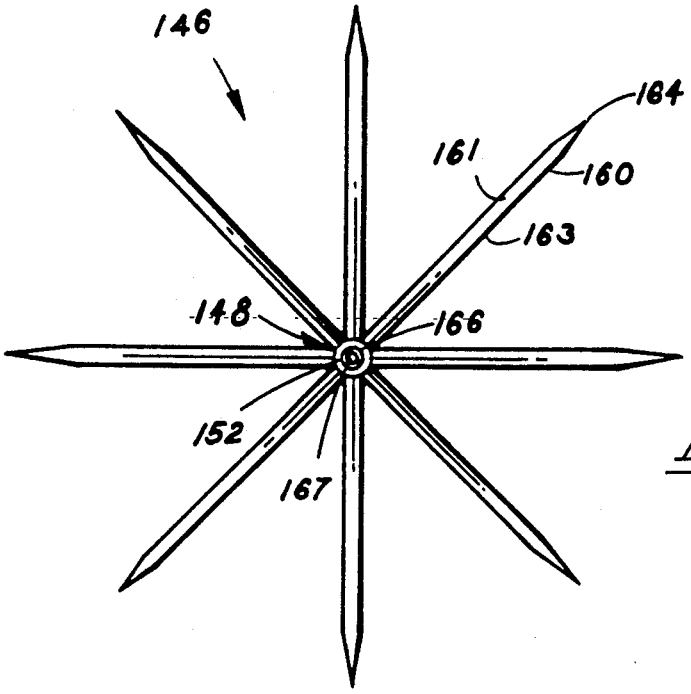
FIG. 7 is a top view of an alternative embodiment of a bristle cluster according to this invention.
Figure 8:
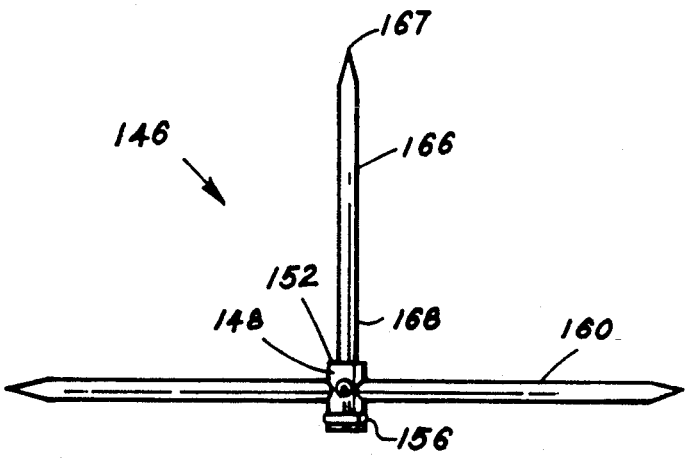
FIG. 8 is a side elevational view of the bristle cluster of FIG. 7.

FIGS. 7 and 8 show an alternative bristle cluster 146 according to this invention. This embodiment has lateral tines 160 which radiate outwardly from center core 148. Tines 160 are tapered near the distal ends and of approximately equal lengths. Bristle cluster 146 also advantageously includes an axial tine 166 which extends axially from the top face 152 of core 148. The axial tine 166 has an end point 167, and a sidewall surface 168. The axial tine may be similarly tapered or of a different shape and length from the lateral tines 160.

FIG. 8 also indicates that bristle cluster 146 further has a locking feature 156. The locking feature is advantageously provided in the form of a locking projection from the lower or stabilizing portion 150 of the core 148. The locking projection is preferably in the configuration of a circumferential ring encircling the stabilizing portion of the central core. The locking ring is preferably located on the lower half of the lower portion 150 of the core 148.

Figure 9:
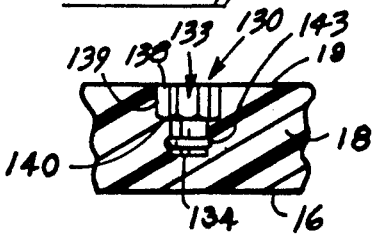
FIG. 9 is a sectional view of an alternative embodiment receptacle according to this invention.
Figure 10:
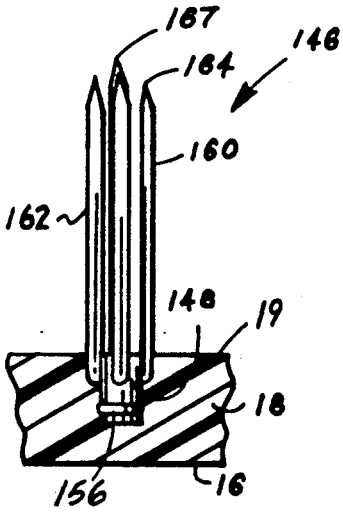
FIG. 10 is a sectional view similar to FIG. 9 with the bristle cluster of FIG. 7 inserted therein.

FIG. 9 shows an alternative embodiment of a receptacle 130 according to this invention. Receptacle 130 is similar to receptacle 30 described above and similar features have been marked with the same reference numerals with an additional "1" in the hundred's column (e.g. 130 versus 30). Receptacle 130 further has a receiving locking means 143. The receiving or mating locking means is adapted to mate with an appropriate locking feature provided on the bristle cluster, such as the locking ring 156 on bristle cluster 146. The receptacle locking feature is advantageously provided in the form of a groove 143 in the lower zone of the receptacle which receives the stabilizer part of the bristle cluster core. The groove is formed in sidewall 135 to extend fully therewithin. The locking ring 156 and locking groove are appropriately coordinated in size and location so that the ring fits within the groove and helps to lock the bristle cluster in place in addition to the mounting provided merely by the stabilizer portion of the core and the bristle more generally within the receptacle 130. The groove 143 is formed at a distance approximately four fifths of the distance from the opening of the receptacle 131 to the bottom surface 134. FIG. 10 shows the bristle cluster 146 installed and locked within the receptacle 130.

Figure 11:
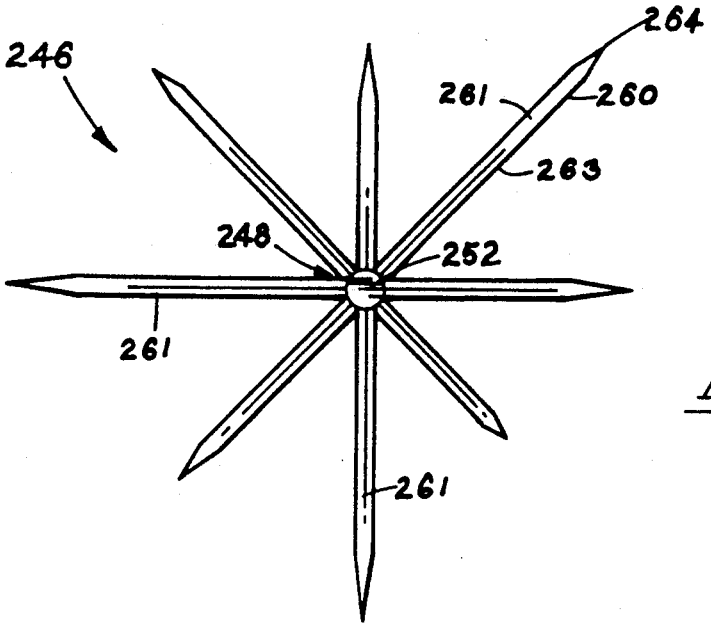
FIG. 11 is a top view of an alternative embodiment of bristle cluster according to this invention.

FIG. 11 shows another alternative embodiment of a bristle cluster 246. This embodiment is comprised of a central core 248 and lateral tines 260. The tines radiate transversely from the central core, and each tine has an upper surface 261, lower surface 262, side surface 263, and a tip 264, as shown in FIG. 11. The tines 260 are tapered near the distal ends and are of unequal lengths in this embodiment.

Figure 12:
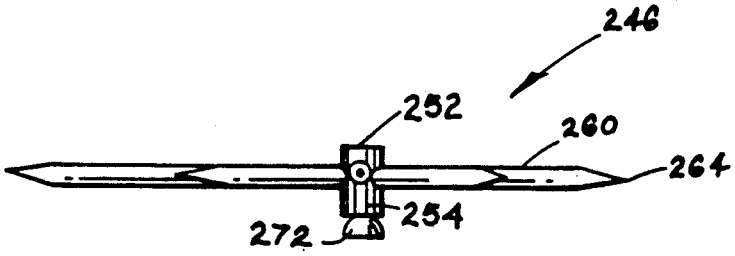
FIG. 12 is a side elevational view of the bristle cluster of FIG. 11.
Figure 13:
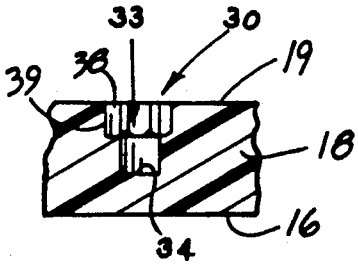
FIG. 13 is a sectional view of a bristle cluster receptacle of FIG. 2.
Figure 14:
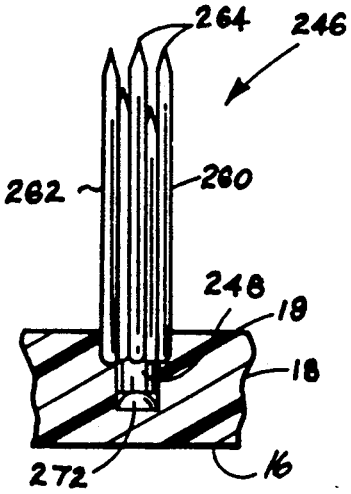
FIG. 14 is a sectional view similar to FIG. 13 with the bristle cluster of FIG. 11 inserted therein.

FIG. 12 shows that bristle cluster core 248 has a top face 252. The bottom face is provided with an optional suction cup 272 which is integrally formed therewith and serves as a bristle cluster retainer. The suction cup of this embodiment is of a semicircular shape although other configurations are possible. The concave side of suction cup 272 directed downwardly to engage and hold against the bottom wall of a receptacle, such as the bottom wall 34 of receptacle 30 which is repeated in FIG. 13 to assist in visualizing the installed combination shown in FIG. 14. The suction cup 272 is pressed against the bottom surface 34 of the receptacle 30, creating a suction force which retains the bristle cluster inside the receptacle. The transverse tines 260 are displaced by the displacement flutes 38, in the same manner as described above for other embodiments of the bristle clusters.

For all of the above described embodiments of bristle clusters, the arrangement of the transverse tines and axial tines on the surface of a brush piece results from the assembly of the unique bristle cluster units into their respective receptacles. Tines of uneven length and axial tines add to the fullness of the bristle tine array on a brush piece.

This invention further discloses methods for assembling the bristle clusters of the above embodiments into their respective receptacles thereby forming a brush or brushing array on other objects of utility. The methods include aligning the bristle cluster and receptacle in an appropriate manner, such as by aligning the axis of the bristle cluster core and the longitudinal axis of the receptacle. The methods further include installing the bristle clusters in the receptacles by inserting the central core of the bristle clusters into the receptacles manually or mechanically. Inserting the bristle clusters also includes forcing and reorienting the tines into the desired reoriented positions such as aligned toward one another or together in an axially extending orientation relative to the axis of the central core. The reorienting occurs by displacing the tines during engagement of the displacement features of the receptacles against the tines. For example, the tines are displaced by the deflection flutes as described above. The tines are preferably reoriented by bending the base of the tines using the curved transition zones forming a part of the preferred displacement flutes.

The novel methods may further include locking, securing or otherwise retaining the bristle cluster in the receptacle. Such retaining can advantageously occur by engaging a locking projection, such as locking ring 156, within a suitable mating receptacle, such as locking groove 143, as indicated above. Alternatively, the bristle cluster may be secured by retaining the core within the receptacle by developing a suction between the suction cup 272 and the bottom wall of the receptacle. This suctioning action can be in lieu of or in addition to other locking action. Such retaining can also occur merely by the mechanical engagement of the stabilizing lower portion of the core within the stabilizing receptacle portion of the second zone of the receptacle.

FIGS. 15 and 16 show a top view and side view of an alternative embodiment of a bristle cluster 388. The tines in this embodiment extend axially from a central juncture 393. FIG. 15 shows a series of outer axial tines 390 surrounding an inner or central axial tine 391 in a circular configuration. The central juncture 393 is connected to an insertion plug 395. The insertion plug 395 has a threaded outer surface 397 above the bottom end 398. FIG. 17 shows a preferred receptacle 301 for this alternative bristle cluster. The receptacle has internal threads 307 along the receptacle sidewall surface 303 suitable for receiving the threads 397 of the bristle cluster plug 395. The bristle cluster 388 is mounted into the receptacle 301 by threading the plug 395 into the receptacle 301. The axial tines extend at a desired angle, such as approximately 90 degrees, from the brush piece surface when the bristle clusters are mounted in the receptacles.

Figure 18:
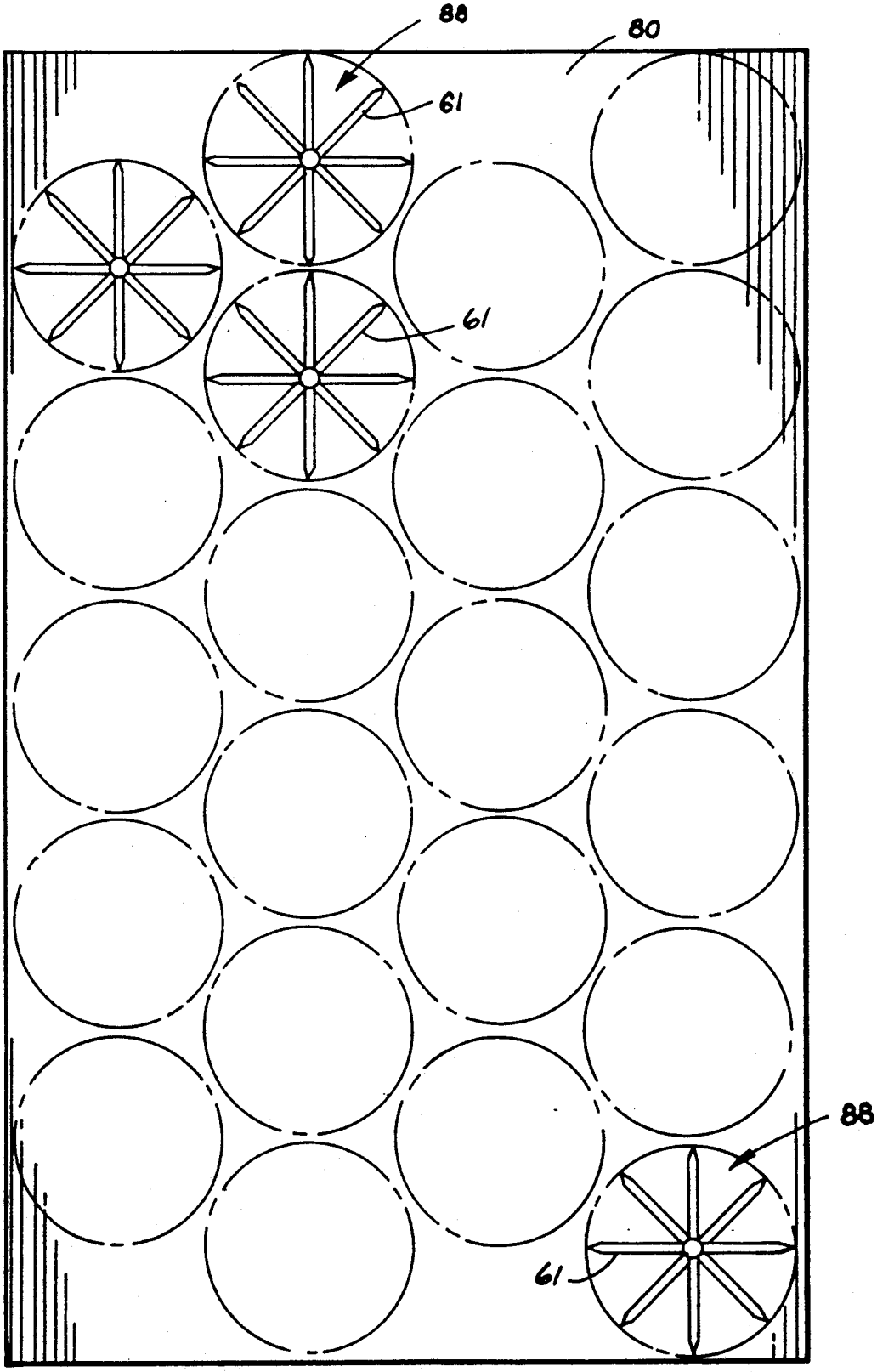
FIG. 18 shows a plan view of a mold for making a plurality of bristle clusters as shown in FIG. 3.

The bristle clusters of this invention are preferably manufactured as an integral unit. Most preferably, this is done using an injection molding process. FIG. 18 shows the surface of a preferred mold 80 with the forms or mold cavities 88 for forming the relaxed bristle clusters 146 of FIG. 7 therein. Typically such a mold would be comprised of an upper mold 82 and a lower mold 83. Preferably the mold would be supplied with an injector nozzle (not shown) or other means for injecting liquid resin or other suitable material into the mold cavities 88. The molded bristle clusters are then manually or, more preferably, mechanically ejected from the mold into a receptacle on a brush piece as will be explained in greater detail next.

FIGS. 19A–19D show a preferred brush making apparatus 100 according to this invention. Brush making apparatus 100 includes three basic portions which are a molding apparatus 80 (also partially shown in FIG. 18), a control unit 115, and a brush body operator 120. The molding apparatus forms the bristle clusters 46 and has ejectors for ejecting the molded bristle clusters and installing them into the brush body 15. The brush body is held by the brush body operator which is advantageously in the form of a robotic arm or other acceptable piece of machinery adapted to hold the brush body and position it as needed for installation of the bristle clusters within the receptacles on the head of the brush body.

Molding machine 80 includes an upper or first mold part 82 and lower or second mold part 84 which are controllably separable by a mold part operator (not shown). The mold part operator movements are controlled by the control unit 115. The mold cavities 88 on each mold part define a volume which when filled with resin provide a bristle cluster 146. Associated with the cavities are an ejector 101 which is also controlled with the control unit 115.

The ejector 101 includes an ejector operator 102 which is used to controllably position a movable ejector piece 103 which is slidably mounted for movement upwardly and downwardly as shown in FIGS. 19A–19D. The ejector operator includes a suitable drive such as an electrical solenoid or fluid actuator. As shown the ejector operator is an electrically operatored solenoid having an electrically conductive coil 110 which is schematically shown. The coil 110 drives a magnet 111 in the typical fashion to move the magnet and attached ejector piece 103 upwardly and downwardly. The ejector piece 103 is positioned by a slide bushing 105, magnet 111, and an ejector piece slide passage 104 formed in the lower mold 84. The sliding assembly is forced downwardly by a compression spring 118. The ejector piece 103 is advantageously shaped at its upper end to form a tapered receptacle which serves as part or all of the mold for the axial tine 166 of bristle cluster 146.

Figure 19A:
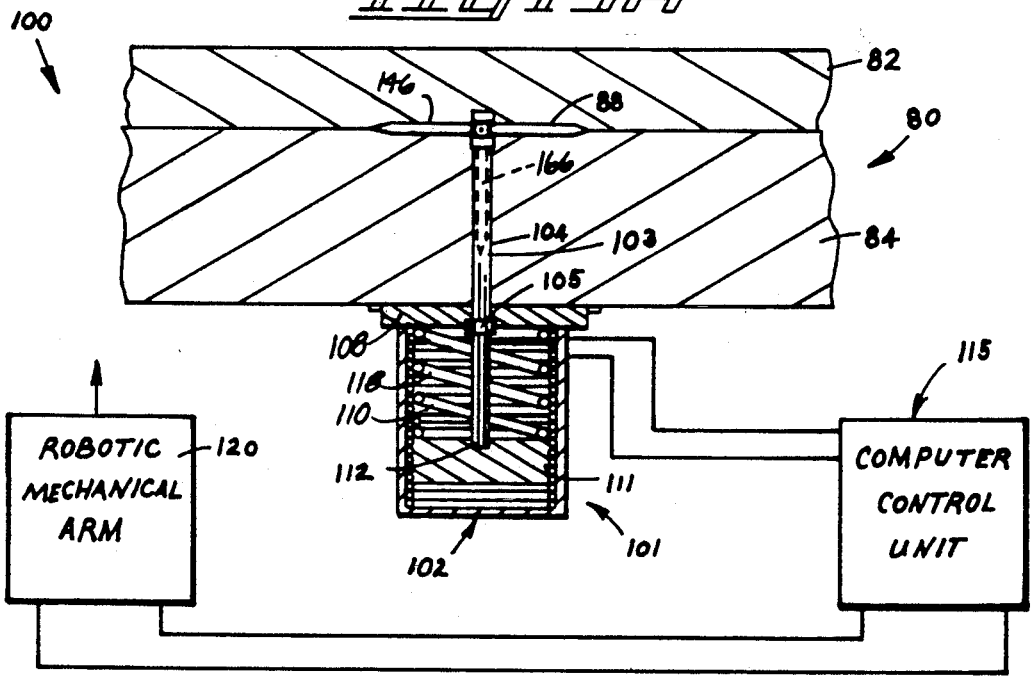
FIG. 19A–19D show a series of steps in molding, ejecting and assembling bristle clusters into a brush piece.
Figure 19B:
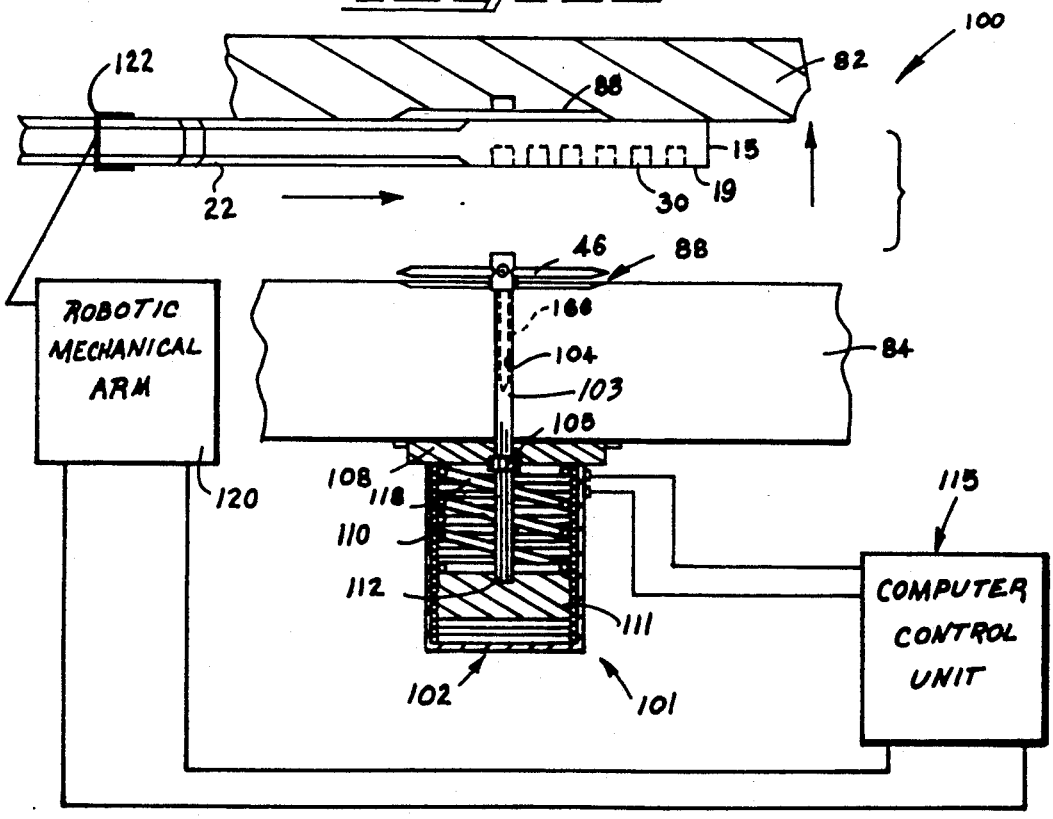
Figure 19C:
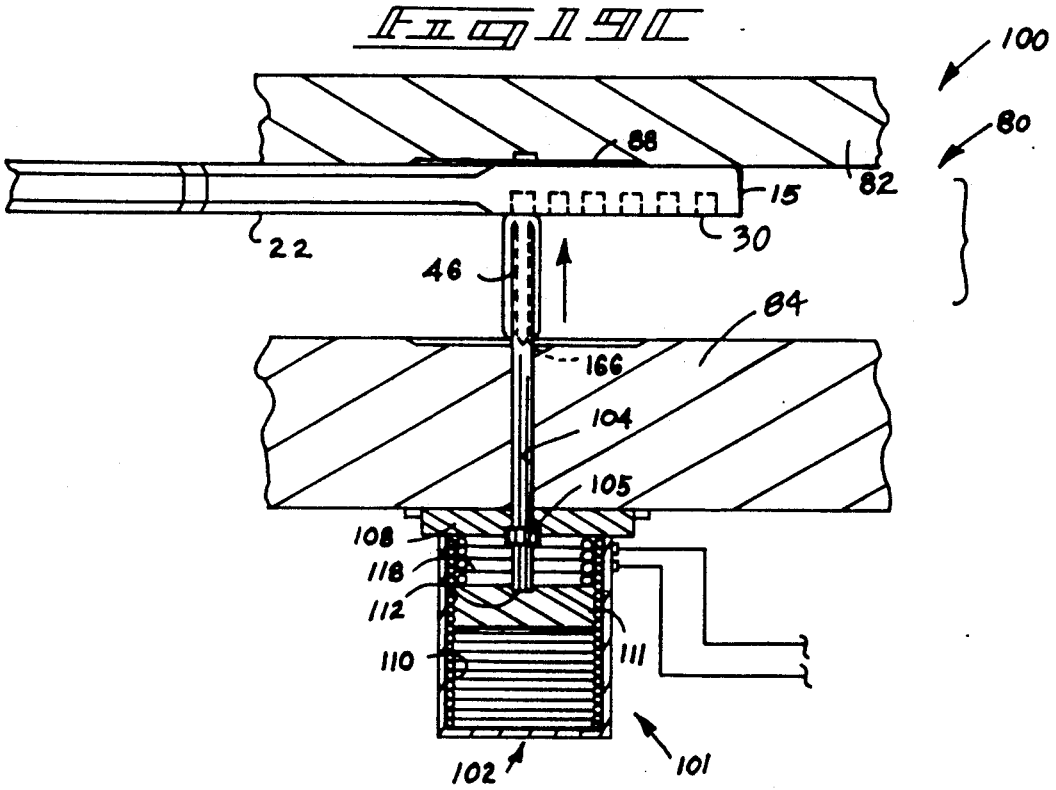
Figure 19D:
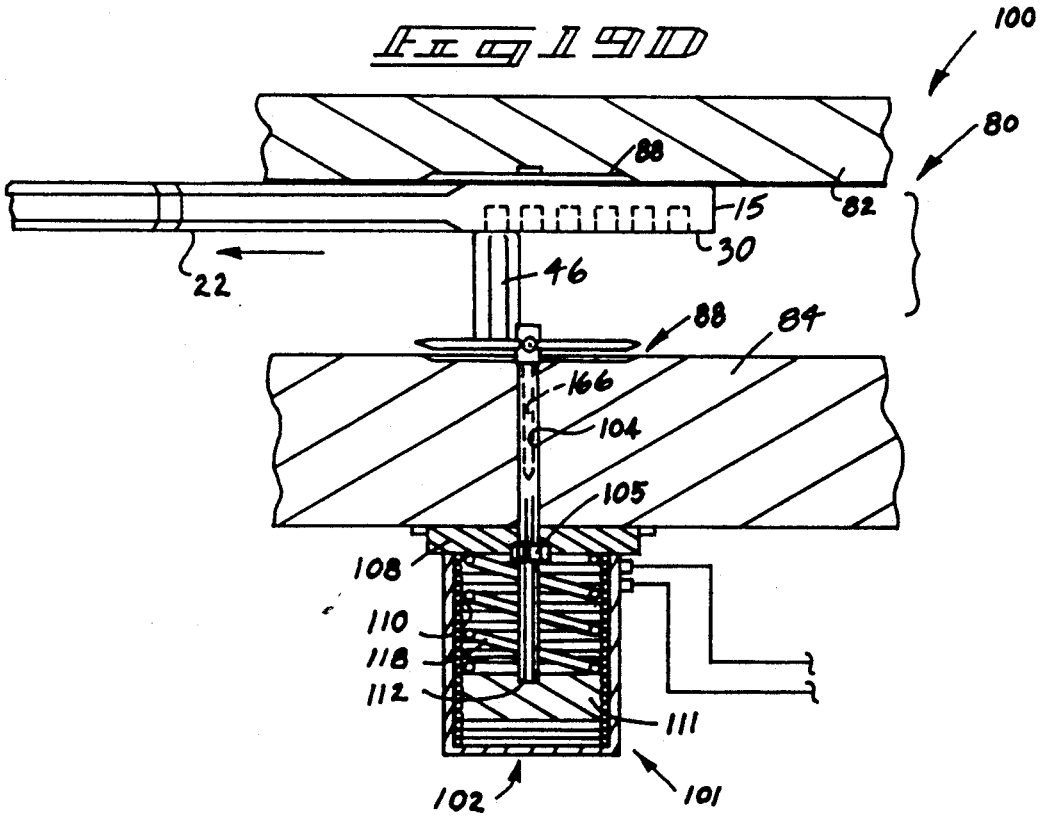

The brush making apparatus 100 functions so as to perform the novel methods described above and additionally defines further novel methods according to this invention. FIG. 19A shows the molding machine closed with the upper and lower molds in contact with the bristle cluster 146 completed. FIG. 19B shows the upper mold separated in response to appropriate control signals from computer or other controller 115 to the mold part operator (not shown). The brush piece operator 120 is similarly controlled by controller 115 with a brush holder 122 which holds and moves a blank brush piece 15 between the molds and appropriately positions it to align a receptacle with the molded bristle cluster 146. The upper mold is advantageously a cold mold to allow it to support the back surface of the brush piece after it has been appropriately positioned. FIG. 19C shows that thereafter the ejector is actuated to extend the ejector piece 103 upwardly and force the bristle cluster 146 into the receptacle of the brush piece as detailed hereinabove. The ejector is then returned by spring 118 into the position of FIG. 19D leaving the installed bristle cluster in the brush piece 15.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A method of assembling bristle clusters into a brush piece of a brush, comprising:

selecting a bristle cluster comprising transverse tines attached to and radiating transversely from a central juncture;

selecting a brush piece having at least one bristle cluster receptacle formed thereon;

aligning said bristle cluster adjacent to the bristle cluster receptacle formed on the brush piece;

inserting the bristle cluster into the bristle cluster receptacle;

reorienting bristle cluster transverse tines by forcing the transverse tines against surfaces of the brush piece during insertion of the bristle clusters into the bristle cluster receptacle.

2. A method according to claim 1 and further comprising ejecting at least one bristle cluster from a mold into a bristle cluster receptacle formed in the brush piece.

3. A method according to claim 2 and further comprising holding the brush piece with a bristle cluster receptacle in aligned relationship with the bristle cluster while the bristle cluster is ejected from the mold into the receptacle.

4. A method according to claim 3 and further comprising moving the brush piece to realign an empty receptacle formed on the brush piece with another bristle cluster.

5. A method according to claim 1 and wherein said selecting a bristle cluster is further defined by selecting a bristle cluster comprising a plurality of transverse tines which are attached to and radiate transversely from a central core; said central core extending axially beyond the transverse tines to facilitate inserting the bristle cluster.

6. A method according to claim 5 and further comprising depressing the central core of the bristle cluster into the receptacle to create suction between the bottom surface of the receptacle and a suction cup attached to a lower face of the central core of the bristle cluster.

7. A method according to claim 5 and further comprising inserting at least one locking means on the central core of a bristle cluster into at least one locking groove in a bristle cluster receptacle.

8. A method according to claim 1 and wherein said transverse tines are reoriented into an approximately axial alignment relative to an axis of the central juncture.

9. A method for making a brush, comprising:

forming a bristle cluster having a plurality of transverse tines radiating transversely from a central juncture, using a bristle cluster forming apparatus;

selecting a brush piece having a bristle cluster receptacle formed therein;

positioning the brush piece so that the bristle cluster receptacle is adjacent to the bristle cluster held in the bristle cluster forming apparatus;

ejecting a bristle cluster from the forming apparatus into the bristle cluster receptacle formed in the brush piece;

reorienting bristle cluster transverse tines by forcing the transverse tines against surfaces of the brush piece during insertion of the bristle clusters into the bristle cluster receptacle.

10. A method according to claim 9 and further defined by repeating the positioning, ejecting and reorienting steps for a plurality of times to install a plurality of bristle clusters in a plurality of bristle cluster receptacles formed in the brush piece.

11. A method according to claim 9 and wherein the step of forming the bristle cluster comprises filling a mold with resin.

12. A method according to claim 9 and wherein the step of ejecting the bristle cluster includes forcing transverse tines into reoriented positions wherein the tines are approximately aligned.

13. A method according to claim 9 and wherein the step of ejecting the bristle cluster includes forcing transverse tines into reoriented positions wherein the tines are aligned with a central axis of the central juncture.

14. A method according to claim 9 and further comprising inserting at least one locking means on the central juncture of a bristle cluster into at least one locking groove in a bristle cluster receptacle.

15. A method according to claim 9 and further comprising depressing the central juncture of the bristle cluster into the receptacle to create suction between a bottom surface of the bristle cluster receptacle and a suction cup upon a lower face of the central juncture of the bristle cluster.

16. A brush making apparatus comprising:

a mold for forming an integral bristle cluster having a plurality of bristle tines;

an ejector for ejecting a bristle cluster from the mold;

a moveable brush piece holder for aligning a brush piece with the bristle cluster in said mold to allow the bristle clusters to be ejected from the mold and into the brush piece.

17. An apparatus according to claim 16 and wherein the mold for forming bristle clusters includes first and second mold parts each having a plurality of bristle cluster cavities therein.

18. An apparatus according to claim 16 wherein there are a plurality of ejectors.

19. A brush making apparatus according to claim 16 and wherein the mold has cavities for forming a plurality of transversely extending bristle tines and at least one cavity for forming an axially extending bristle tine.

20. An apparatus according to claim 16 and wherein the mold for forming bristle clusters comprises first and second mold parts;

and further comprising a slide passage formed in one of said mold parts;

and wherein said ejector includes an ejector piece which slides within the slide passage to eject the bristle cluster from the mold.

21. An apparatus according to claim 16 and wherein the mold for forming bristle clusters comprises first and second mold parts;

and further comprising a slide passage formed in one of said mold parts;

and wherein said ejector includes an ejector piece which slides within the slide passage to eject the bristle cluster from the mold, the ejector piece having an axial tine receptacle which forms a mold for an axially extending bristle tine.

22. A brush making apparatus according to claim 16 and wherein:

the mold for forming bristle clusters includes first and a second mold parts each having a plurality of bristle cluster cavities therein; each bristle cluster cavity having a plurality of transversely extending bristle tine cavities;

there are a plurality of ejectors;

and further comprising slide passages formed in one of said mold parts;

and wherein said ejectors include an ejector piece which slides within the slide passage to eject the bristle cluster from the mold.

23. A brush making apparatus according to claim 16 and wherein:

the mold for forming bristle clusters includes first and a second mold parts each having a plurality of bristle cluster cavities therein; each bristle cluster cavity having a plurality of transversely extending bristle tine cavities;

there are a plurality of ejectors;

and further comprising slide passages formed in one of said mold parts;

said ejectors include an ejector piece which slides within the slide passage to eject the bristle cluster from the mold, the ejector piece having an axial tine receptacle which forms a mold for an axially extending bristle tine.

24. A method for making a brush, comprising:

forming a bristle cluster having a plurality of transverse tines radiating transversely from a central juncture with a bristle cluster forming apparatus;

selecting a brush piece having a plurality of bristle cluster receptacles formed therein;

positioning the brush piece so that the bristle cluster receptacle is adjacent to the bristle cluster held in the bristle cluster forming apparatus;

ejecting a bristle cluster from the forming apparatus into the bristle cluster receptacle formed in the brush piece.

25. A method according to claim 24 and further defined by repeating the positioning and ejecting steps for a plurality of times to install a plurality of bristle clusters in a plurality of bristle cluster receptacles formed in the brush piece.

26. A method according to claim 24 and wherein the step of forming the bristle cluster comprises filling a mold with resin.

27. A method according to claim 24 and wherein the step of ejecting the bristle cluster includes forcing transverse tines into reoriented positions wherein the tines are approximately aligned.

28. A method according to claim 24 and wherein the step of ejecting the bristle cluster includes forcing transverse tines into reoriented positions wherein the tines are aligned with a central axis of the central juncture.

29. A method according to claim 24 and further comprising inserting at least one locking means on the central juncture of a bristle cluster into at least one locking groove in a bristle cluster receptacle.

30. A method according to claim 24 and further comprising depressing the central juncture of the bristle cluster into the receptacle to create suction between a bottom surface of the bristle cluster receptacle and a suction cup upon a lower face of the central juncture of the bristle cluster.

* * * * *